US008231209B2

(12) United States Patent
Koizumi et al.

(10) Patent No.: US 8,231,209 B2
(45) Date of Patent: Jul. 31, 2012

(54) LIQUID JETTING SYSTEM, LIQUID CONTAINER, HOLDER, AND LIQUID JETTING APPARATUS HAVING HOLDER

(75) Inventors: Yoshihiro Koizumi, Shiojiri (JP); Takeshi Iwamuro, Matsumoto (JP); Hitoshi Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 12/409,303

(22) Filed: Mar. 23, 2009

(65) Prior Publication Data

US 2009/0244224 A1 Oct. 1, 2009

(30) Foreign Application Priority Data

Mar. 25, 2008 (JP) ..... 2008-077733
Mar. 25, 2008 (JP) ..... 2008-077741

(51) Int. Cl.
*B41J 2/175* (2006.01)
*B41J 2/17* (2006.01)

(52) U.S. Cl. ..... 347/85; 347/84; 347/86

(58) Field of Classification Search ..... 347/86
See application file for complete search history.

(56) References Cited

U.S. PATENT DOCUMENTS 5,971,534 A * 10/1999 Sasaki et al. ..... 347/86
6,050,669 A * 4/2000 Yano et al. ..... 347/23
6,170,937 B1 * 1/2001 Childers et al. ..... 347/85
6,264,314 B1 * 7/2001 Mochizuki et al. ..... 347/86
6,832,830 B2 * 12/2004 Seino et al. ..... 347/86
7,008,053 B2 * 3/2006 Hashii et al. ..... 347/86
7,293,864 B2 * 11/2007 Kimura et al. ..... 347/86
7,431,439 B2 * 10/2008 Fujioka ..... 347/86
7,575,300 B2 * 8/2009 Kobayashi ..... 347/49
7,789,487 B2 9/2010 Kawamura
2003/0007023 A1 1/2003 Barclay et al.
2005/0083374 A1 4/2005 Graf et al.
2005/0248637 A1 * 11/2005 Seino et al. ..... 347/86
2007/0229628 A1 * 10/2007 Yano ..... 347/86

FOREIGN PATENT DOCUMENTS

EP 0 412 459 A2 2/1991
EP 0 770 489 A1 5/1997
EP 1 231 063 A2 8/2002
EP 1 231 063 A3 8/2003
JP 2003-341100 A 12/2003
JP 2007-268983 A 10/2007

* cited by examiner

*Primary Examiner* — Stephen Meier
*Assistant Examiner* — Jeremy Bishop

(57) ABSTRACT

The liquid container has a side wall with a bias-force receiving part. The liquid jetting apparatus has a liquid container holder. The holder is equipped with a feed needle, a holder-side electrode, and bias force part. The feed needle receives feed of liquid from the liquid container. The holder-side electrode is electrically connected with the container. The bias force part exerts a bias force on the bias-force receiving part. The liquid container is equipped with a feed part with a feed port and a container-side electrode. The feed port opens onto the front wall and receives the feed needle. The container-side electrode is secured to be electrically connected with the holder-side electrode. The biasing direction is established such that an extended line extending in the biasing direction from the bias-force receiving part is offset from the container-side electrode towards the side wall side.

16 Claims, 14 Drawing Sheets

LIQUID JETTING SYSTEM, LIQUID CONTAINER, HOLDER, AND LIQUID JETTING APPARATUS HAVING HOLDER

CROSS REFERENCE TO RELATED APPLICATIONS

This application relates to and claims priority from Japanese Patent Application No. 2008-077733, filed on Mar. 25, 2008 and Japanese Patent Application No. 2008-077741, filed on Mar. 25, 2008, the entire disclosure of which is incorporated by reference.

BACKGROUND

1. Technical Field

The present invention relates to a liquid container, to a liquid jetting system, to a holder, and to a liquid jetting apparatus equipped with a holder; and relates in particular to a liquid container that is installable in a holder of a liquid jetting apparatus by being inserted in a prescribed insertion direction, to a liquid jetting system incorporating the liquid container, to a holder adapted to receive installation of the liquid container by insertion in a prescribed insertion direction, and to a liquid jetting apparatus equipped with the holder.

2. Related Art

In the field of ink-jet printers, designs whereby the ink-jet printer is supplied with ink from an ink cartridge containing ink and detachably installed in an ink cartridge are known. Some ink cartridges used in such ink-jet printers are provided with an IC chip that stores information such as the type and color of ink, and the currently remaining ink level. On the ink-jet printer side, an ink cartridge holder adapted to receive the ink cartridge is provided with electrodes at locations corresponding to electrodes on the IC chip. With the ink cartridge installed in the ink cartridge holder, the electrodes of the IC chip and the electrodes on the ink cartridge holder will be positioned in electrical contact for example, thereby connecting the ink cartridge and the IC chip so as to enable communication between them.

However, in conventional designs, there was a risk that when the ink cartridge is installed in the holder, the ink cartridge would sometimes become detached from the holder. This problem is not one that is limited to ink cartridges and holders used in ink-jet printers, but is a problem common generally to liquid containers installable in liquid devices, and to holders designed to accommodate installation of such liquid containers.

SUMMARY

Therefore, it is one object of the present invention to prevent detachment of a liquid container in a liquid container installable in a liquid jetting apparatus and a holder adapted to receive installation of such a liquid container.

A first aspect of the invention provides a liquid jetting system. The liquid jetting system pertaining to the first aspect comprises a liquid container including a front wall, and a side wall having a bias-force receiving part, and a liquid jetting apparatus including a holder that receives installation of the liquid container through insertion of the liquid container in a prescribed insertion direction with the front wall facing forward. The holder further includes a liquid feed needle that receives feed of liquid from the liquid container when the liquid container has been installed, a holder-side electrode situated to a upper side from the liquid feed needle and adapted to electrically connect with the liquid container when the liquid container has been installed, and bias force part situated to a lower side from the liquid feed needle and adapted to exert a bias force on the bias-force receiving part of the liquid container in a prescribed biasing direction when the liquid container has been installed. The liquid container further includes a feed part having a liquid feed port that opens onto the front wall and that receives insertion of the liquid feed needle when the liquid container has been installed in the holder, and a container-side electrode that is to be secured at such a location as to electrically connect with the holder-side electrode when the liquid container has been installed in the holder. The biasing direction is established such that an extended line extending in the biasing direction from the bias-force receiving part is offset from the container-side electrode towards the side wall side.

According to this arrangement, biasing force received by the bias-force receiving part will give rise to rotational moment acting to rotate the liquid container in the insertion direction about a center situated in proximity to the holder-side electrode and the container-side electrode which is connected with the holder-side electrode. As a result, the liquid container can be prevented from detaching from the holder.

In the liquid jetting system pertaining to the first aspect, the holder further may include a holder-side positioning part. The liquid container may further include a container-side positioning part that, with the liquid container installed in the holder, contacts the holder-side positioning part to effect positioning of the container-side electrode with respect to the holder-side electrode at a positioning point. The biasing direction may be established such that an extended line extending in the biasing direction from the bias-force receiving part is offset from the positioning point between the holder-side positioning part and the container-side positioning part towards the side wall side.

In this case, biasing force received by the bias-force receiving part will give rise to rotational moment acting to rotate the liquid container in the insertion direction about a center on the positioning part. As a result, the liquid container can be prevented from detaching from the holder.

In the liquid jetting system pertaining to the first aspect, the bias force part of the holder may include a hook adapted to abut the bias-force receiving part to exert the bias force on the bias-force receiving part. The bias-force receiving part may include an abutting face adapted to abut the hook. The abutting face of the bias-force receiving part may lie on a circular arc that is centered on the positioning point and that may pass through the abutting face.

In this case, the bias-force receiving part can maintain contact with the hook even if the liquid container should experience some movement centered on the positioning part. As a result, the liquid container can be prevented from detaching from the holder.

In the liquid jetting system pertaining to the first aspect, the side wall of the liquid container may include a recessed part that includes a recessed face recessed from other sections around the recessed face. The abutting face of the bias-force receiving part may extend to the recessed face.

In this case, sufficient length of the contact face of the force receiving part can be ensured. As a result, the liquid container can be prevented from detaching from the holder.

In the liquid jetting system pertaining to the first aspect, the holder-side positioning part may include a positioning pin situated to a upper side from the liquid feed needle. The container-side positioning part may include a fitted hole adapted to have the positioning pin fit into when the liquid container has been installed in the holder.

In this case, positioning can be accomplished through a simple design.

In the liquid jetting system pertaining to the first aspect, the holder-side positioning part may include a holder-side flat part. The container-side positioning part may include a container-side flat part disposed on the front wall and adapted to abut the holder-side flat part when the liquid container has been installed in the holder.

In this case, positioning can be accomplished through a simple design.

A second aspect of the invention provides a holder that receives installation of the liquid container having a front wall and a side wall orthogonal to the front wall through insertion of the liquid container in a prescribed insertion direction with the front wall facing forward. In holder pertaining to the second aspect, the front wall of the liquid container includes a liquid feed part situated in a center part of the front wall, and a container-side positioning part situated to an opposite side of the front wall than the liquid feed part from the side wall. The side wall of the liquid container includes a bias-force receiving part at a prescribed location. The holder comprises a liquid intake part that connects to the liquid feed part when the liquid container has been installed, a holder-side positioning part that connects to the container-side positioning part when the liquid container has been installed, for securing a location of the container-side positioning part with respect to the holder, and a bias force part that exerts a bias force on the bias-force receiving part in a biasing direction when the liquid container has been installed. The biasing direction is established such that an extended line extending in the biasing direction from the bias-force receiving part is offset from the container-side positioning part towards the side wall side.

According to this arrangement, the biasing force received by the bias-force receiving part will give rise to rotational moment that rotates the liquid container in the insertion direction centered on the positioning part. As a result, the liquid container can be prevented from detaching from the holder.

In the holder pertaining to the second aspect, the bias force part may lie to a lower side from the liquid intake part.

In this case, large size of the holder at its upper side due to the bias force part can be avoided.

In the holder pertaining to the second aspect, the bias force part includes a hook that is swingable in a vertical direction and that has a first abutting part adapted to abut the bias-force receiving part when the liquid container has been installed, a reciprocating member that is reciprocatable in the biasing direction and that has a second abutting part adapted to abut the hook, and a resilient member that biases the reciprocating member in the biasing direction.

In this case, the bias force part adapted bias in the aforementioned biasing direction can be achieved with a simple design.

In the holder pertaining to the second aspect, the resilient member may include a coil spring.

This arrangement is inexpensive as compared with a plate spring.

In the holder pertaining to the second aspect, the reciprocating member may include a through-hole passing through in a direction substantially orthogonal to the biasing direction. The bias force part may further include a shaft adapted to rotatably fit the through-hole. The shaft may include a stopper that in a first rotational position prevents the reciprocating member from moving in a direction opposite the biasing direction, and that in a second rotational position allows the reciprocating member to move in the direction opposite the biasing direction.

In this case, through rotation of the shaft it will be possible to easily switch between restraining and allowing reciprocating motion of the reciprocating member.

In the holder pertaining to the second aspect, the holder may receive installation of a plurality of liquid containers. The hook, the reciprocating member, and the resilient member of the bias force part may be provided individually for each of the plurality of liquid containers. The shaft may fit each of the through-holes of the plurality of the reciprocating members.

In this case, it will be possible with a single shaft to easily switch between restraining and allowing reciprocating motion of a plurality of reciprocating members provided to each of a plurality of liquid containers.

In the holder pertaining to the second aspect, the liquid container may include a container-side electrode arranged on a face lying along the insertion direction. The holder may further include a holder-side electrode that contacts the container-side electrode when the liquid container has been installed. The holder-side electrode is situated in proximity to the holder-side positioning part.

In this case, with the liquid container installed in the holder, accuracy of contact between the container-side electrode and the holder-side electrode can be improved.

In the holder pertaining to the second aspect, the container-side positioning part may include a positioning hole that opens onto the front wall of the liquid container. The holder-side positioning part may include a positioning pin that inserts into the positioning hole when the liquid container has been installed.

In this case, by using the positioning hole and the positioning pin, the liquid container can be positioned easily relative to holder.

In the holder pertaining to the second aspect, the container-side positioning part may include a container-side flat part disposed on the front wall of the liquid container. The holder-side positioning part may include a holder-side flat part adapted to abut the container-side positioning part when the liquid container has been installed.

In this case, by placing the receptacle flat portion in contact against the holder flat portion, the liquid container can be positioned easily relative to holder.

In the holder pertaining to the second aspect, the liquid feed part may include a liquid feed port that opens onto the front wall of the liquid container. The liquid intake part may include a liquid intake needle that inserts into the liquid feed port when the liquid container has been installed.

In this case, liquid can be supplied from the liquid container through the liquid feed needle.

The present invention can be realized in various aspects, for example, a liquid jetting apparatus or ink jetting printer having the holder according to the above mentioned aspects, and adapted to jet a liquid that has been drawn in from the liquid container via the liquid intake part.

The above and other objects, characterizing features, aspects and advantages of the present invention will be clear from the description of preferred embodiments presented below along with the attached figures.

DETAILED DESCRIPTION OF THE PREFERRED EMBODIMENTS

A. Embodiment

Figure 1:
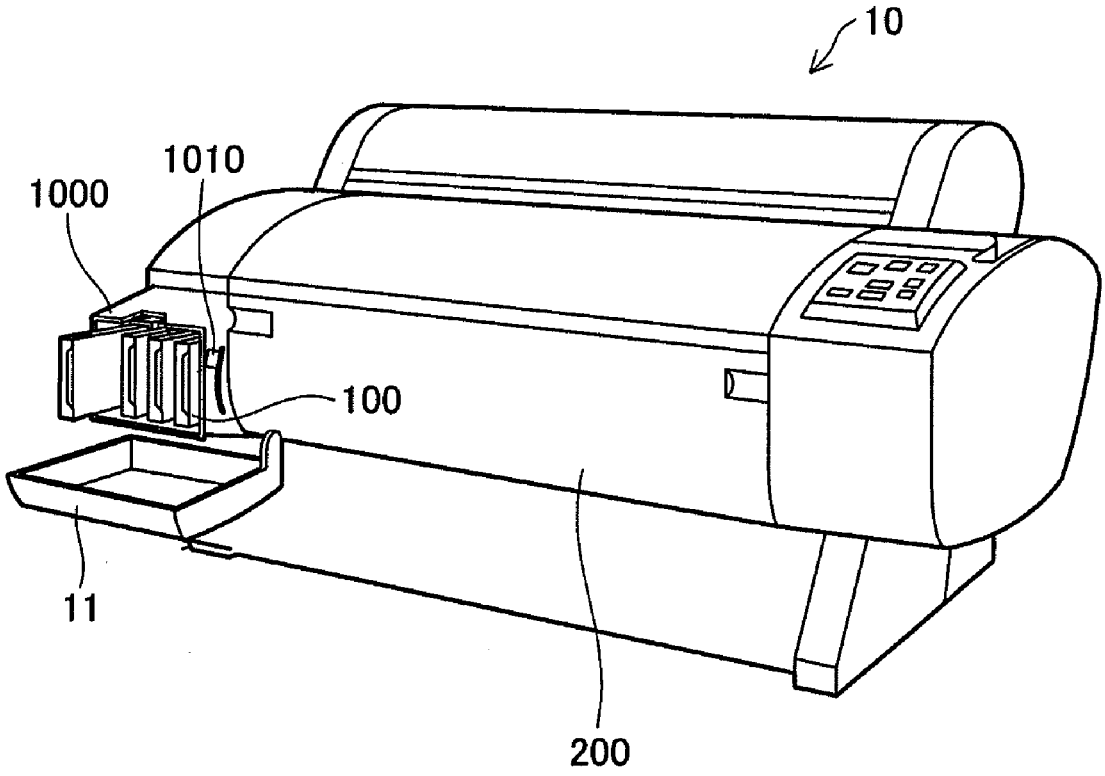
FIG. 1 is a perspective view of an ink-jet printer as an embodiment of the present invention.

FIG. 1 is a perspective view of an ink-jet printer as an embodiment of the present invention. This ink-jet printer 10 is furnished with a printer chassis 200, and with a holder 1000 disposed in a section of the printer chassis 200, for receiving installation of ink cartridges. The holder 1000 of the ink-jet printer 10 has a rotatable cover 11 and a lock lever 1010. One example of the ink-jet printer 10 would be a large-format ink-jet printer adapted to record large-size paper (e.g. A2 to A0 size) for posters or the like. The holder 1000 houses several ink cartridges 100. The ink cartridges 100, which respectively contain inks of prescribed color, are installed in a row in the holder 1000. The ink-jet printer 10 can thereby carry out full color printing onto the printer paper.

Figure 2:
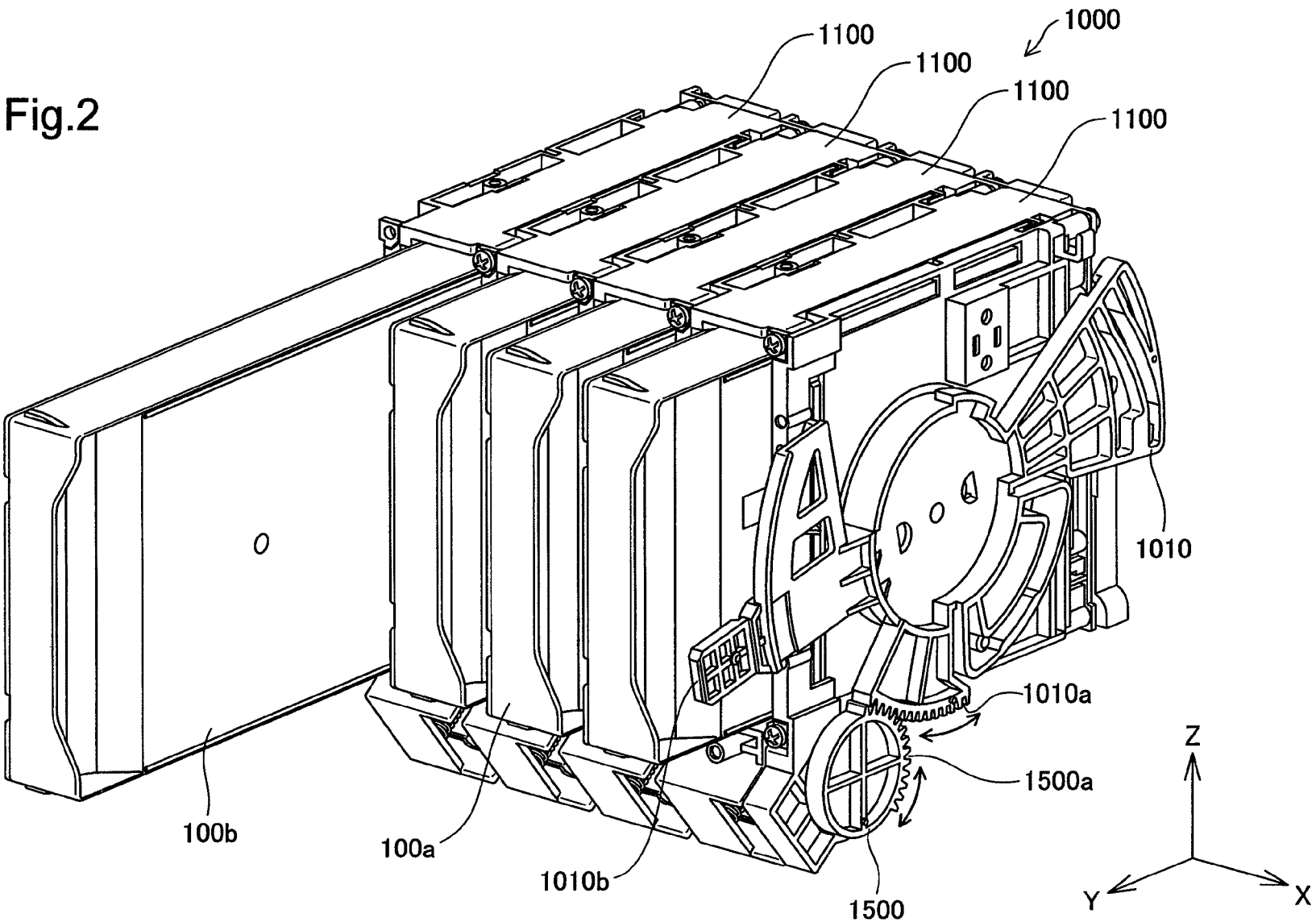
FIG. 2 is an enlarged view depicting several ink cartridges installed in the holder.

FIG. 2 is an enlarged view depicting several ink cartridges 100 installed in the holder 1000. The holder 1000 is furnished with holder bodies 1100 equal in number to the installable ink cartridges 100; a lock lever 1010; and a lock shaft 1500. Each single holder body 1100 can house one ink cartridge 100. Because the ink-jet printer 10 of the present embodiment is designed for color printing using inks of the four colors black, cyan, magenta, and yellow, four holder bodies 1100 connected together in the X axis direction have been provided for the ink cartridges 100 of each color. In FIG. 2, the leftmost holder body 1100 is a holder designed to accommodate an ink cartridge of a color (typically black) for which a large ink cartridge 100*b* is provided. The other holder bodies 1100 are holders designed to accommodate ink cartridges of colors for which standard size cartridges 100*a* are provided. The lock lever 1010 is attached rotatably about an axis of rotation parallel to the X axis. The lock shaft 1500, like the lock lever 1010, is attached rotatably about another axis of rotation parallel to the X axis.

FIG. 2 depicts a condition in which the lock lever 1010 has been rotated until its finger grip 1010*b* situated is at the lower end position. A lock lever gear 1010*a* is formed at the lower side of the lock lever 1010. A similar lock shaft gear 1500*a* is formed on the lock shaft 1500. The lock lever gear 1010*a* and the lock shaft gear 1500*a* mesh, so that when the lock lever 1010 is rotated the lock shaft 1500 undergoes interlocked rotation. With the lock lever 1010 rotated until the finger grip 1010*b* is situated at the lower end position, the rotation position of the lock shaft 1500 will be the locking position, discussed later. Conversely, with the lock lever 1010 rotated until the finger grip 1010*b* is situated at the upper end position, the rotation position of the lock shaft 1500 will be the release position, discussed later. Where the lock shaft 1500 is in the locking position the ink cartridges 100 cannot be removed from the holder bodies 1100; whereas when the rotation position is the release position the ink cartridges 100 can be removed from the holder bodies 1100. The locking mechanism for the ink cartridges will be discussed in further detail later.

Figure 3:
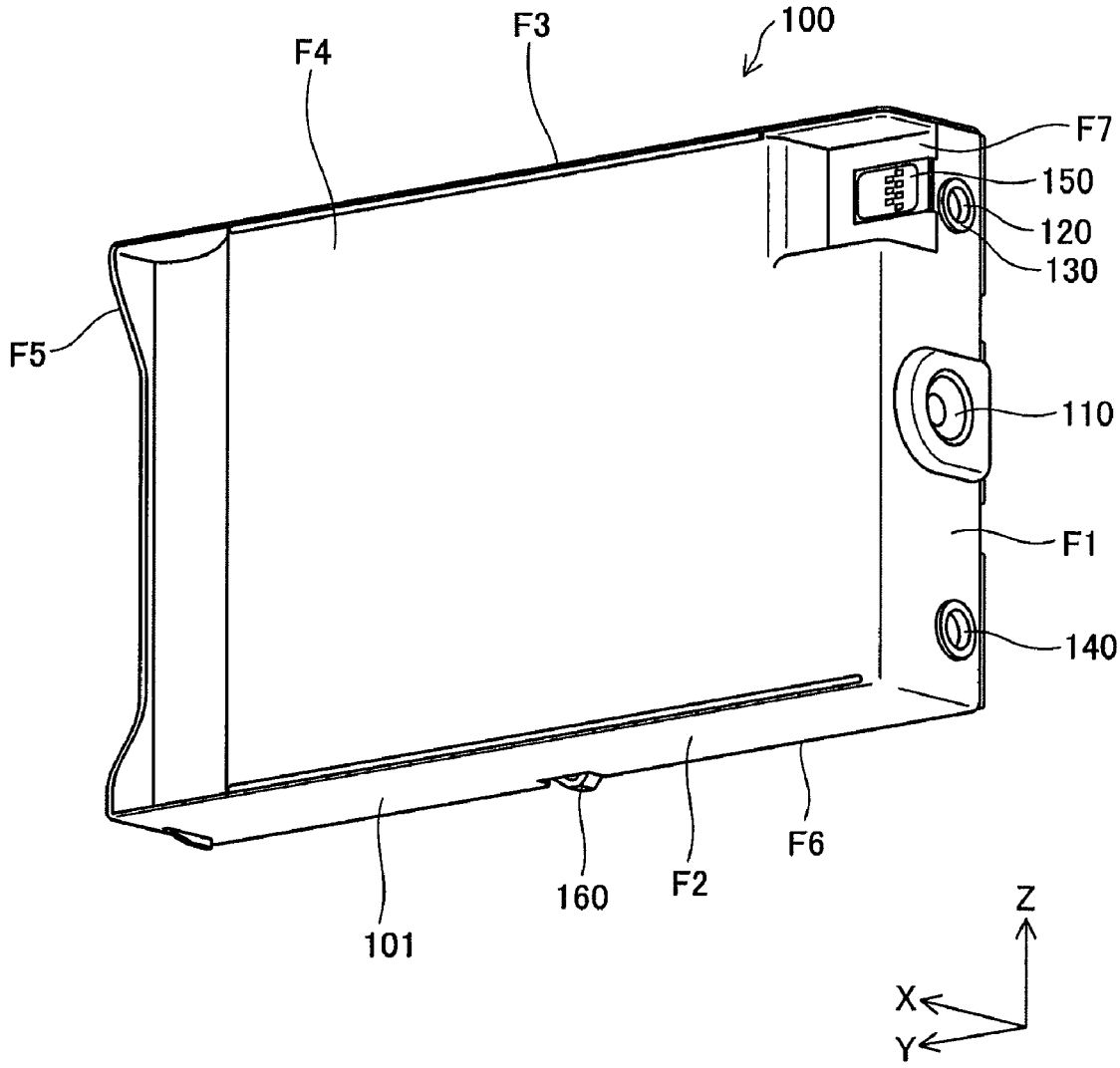
FIG. 3 is a perspective view of an ink cartridge as an embodiment of the present invention.

FIG. 3 is a perspective view of an ink cartridge as an embodiment of the present invention. The receptacle body 101 of the ink cartridge 100 has generally rectangular parallelepiped shape. The wall surface lying to the negative direction side of the Y axis of the receptacle body 101 in FIG. 2 is termed the front wall surface F1. Similarly, the wall surface lying to the positive direction side of the Z axis of the receptacle body 101 is termed the top wall surface F3; the wall surface lying to the negative direction side of the Z axis is termed the bottom wall surface F2; the wall surface lying to the positive direction side of the X axis is termed the right wall surface F4; the wall surface lying to the negative direction side of the X axis is termed the left wall surface F6; and the wall surface lying to the positive direction side of the Y axis is termed the back wall surface F5, respectively. The upper right corner part of the right wall surface F4 in FIG. 2 is formed with recessed contours, and at this corner there is formed a board placement wall surface F7 that is lower in the negative direction in the X direction than is the right wall surface F4.

A circuit board 150 is arranged on the board placement wall surface F7. On the front wall surface F1 there are formed an ink feed part 110, a positioning hole 120 and a flat positioning part 130 provided as container-side positioning part; and a guide hole 140. The positioning flat part 130 projects up from the perimeter of the front wall surface F1 at the rim of the aperture of the positioning hole 120. An bias-force receiving part 160 is formed on the lower wall surface F2. On the back wall surface F5, grip-like contours are formed for the purpose of facilitating gripping of the ink cartridge 100 by the user. These grip-like contours are designed on the assumption that the user will grip the ink cartridge 100 from the right side with the right hand.

While not depicted in the illustration, the interior of the receptacle body 101 is designed to hold a prescribed amount of ink. One exemplary means for holding ink in the interior of the receptacle body 101 would be for example a pliable ink pack having an ink supply port and adapted to be accommodated inside the receptacle body 101. The ink pack will then be filled with ink, and the ink supply port that has been formed in the ink pack will be fastened to the ink feed part 110 of the receptacle body 101.

Figure 4:
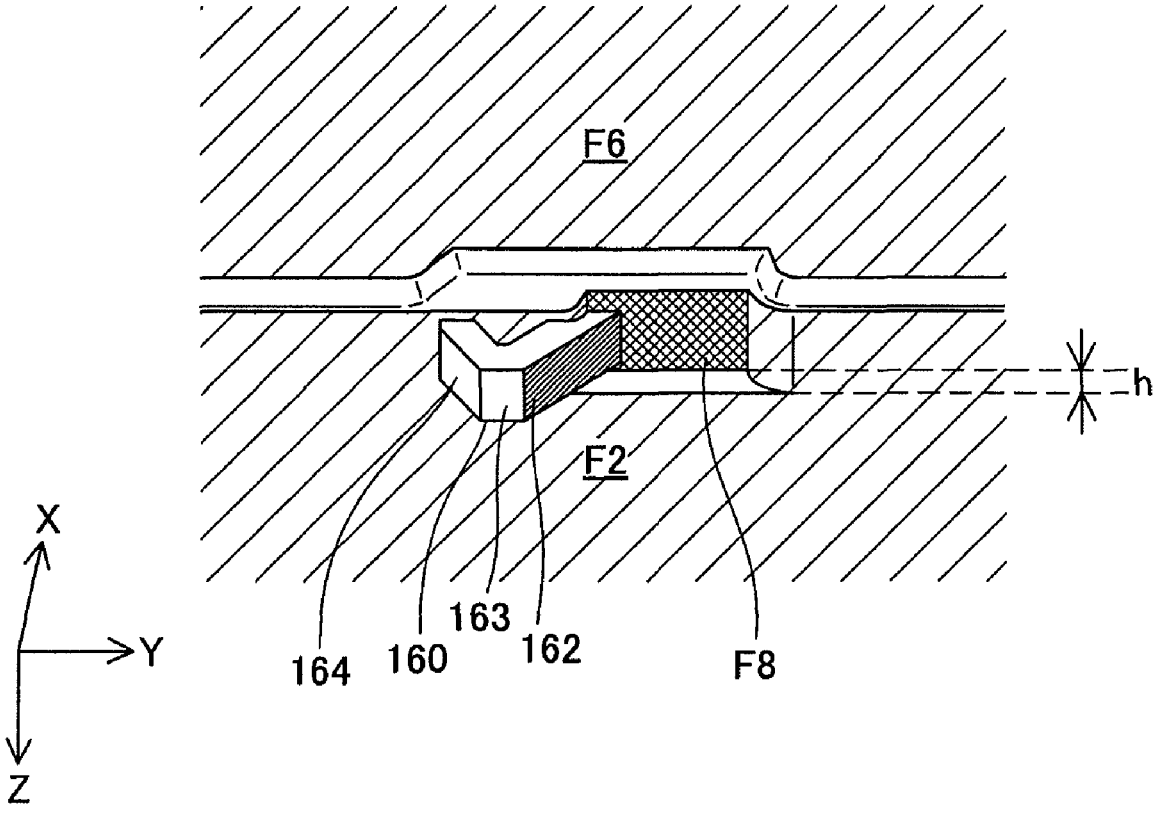
FIG. 4 is a diagram depicting the design of the bias-force receiving part.

FIG. 4 is a diagram depicting the design of the bias-force receiving part 160. The bias-force receiving part 160 is disposed in proximity to the side at which the bottom wall surface F2 and the left wall surface F6 intersect. The bias-force receiving part 160 has generally trapezoidal shape viewed from the Z axis direction; and has a first face 162, a second face 163, and a third face 164 defined as faces that lie parallel to the Z axis direction. The first face 162 (indicated by hatching) is a face adapted to be disposed contact a hook member of the holder (discussed later) and to receive biasing force by the hook member (i.e. the urged face). A recessed portion that defines a face F8 at a location lower than the bottom wall surface F2 by a depth h is formed to the Y axis direction side of the bias-force receiving part 160. The recessed portion base face F8 is parallel to the bottom wall surface F2. The first face 162 does not intersect the bottom wall surface F2, but does intersect the recessed portion base face F8. That is, the first face 162 extends down until it intersects the recessed portion base face F8, giving it larger surface area than if it intersected the bottom wall surface F2.

Figure 5A:
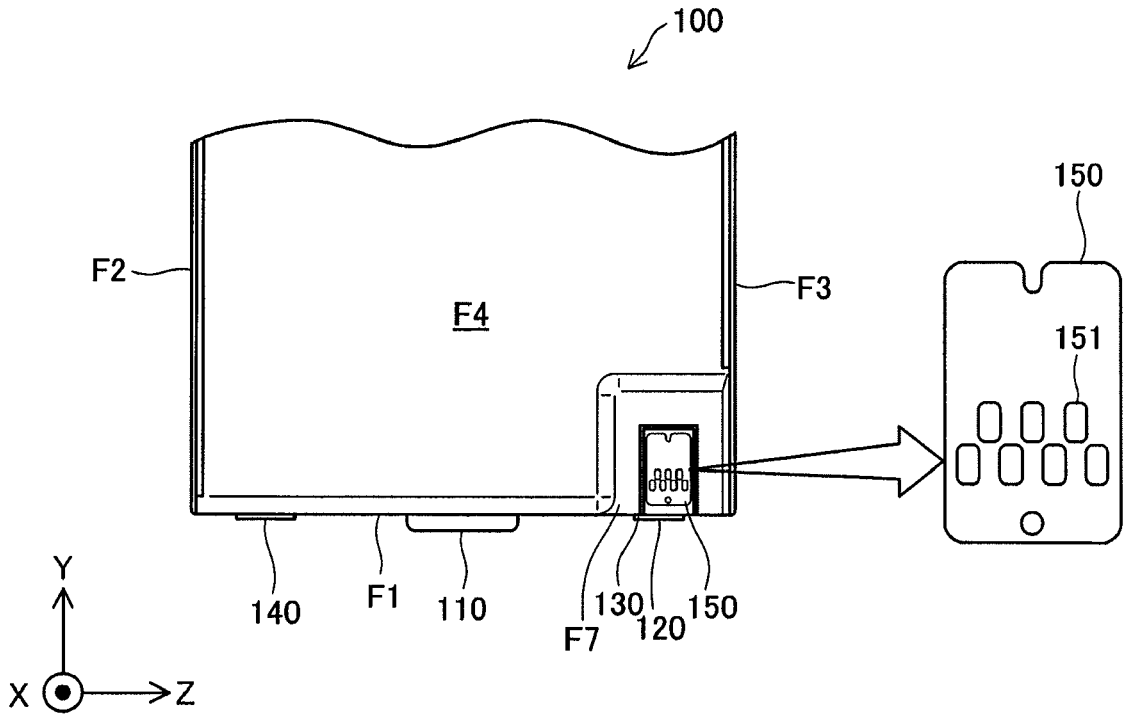
FIGS. 5A-B are diagrams depicting configurations in proximity to the front wall surface F1 of the ink cartridge.
Figure 5B:
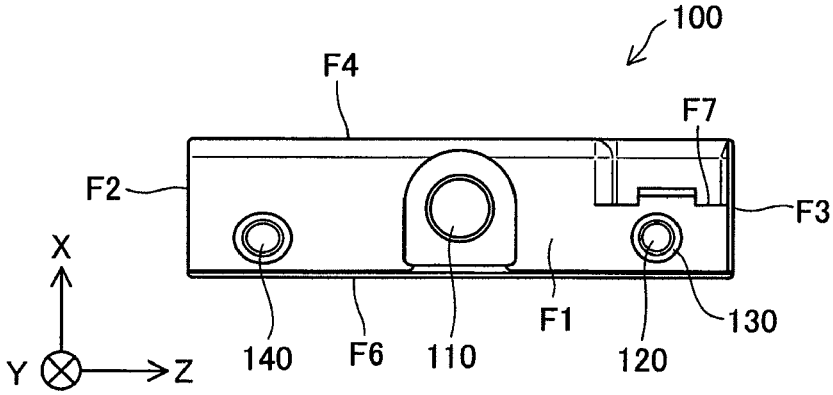

FIGS. 5A-B are diagrams depicting configurations in proximity to the front wall surface F1 of the ink cartridge 100. The circuit board 150 is arranged positioned parallel to the right wall surface F4 and to the board placement wall surface F7. On the back side of the circuit board 150 there is an on-board nonvolatile memory (e.g. EEPROM), not shown. The memory stores information such as the type of ink and ink cartridge, the color of the ink held in the ink cartridge, the current ink level, and so on. Several container-side electrodes (terminals) 151 are formed on the surface of the circuit board 150. The container-side electrodes 151 are designed to contact and electrically connect with holder-side electrode (described later) when the ink cartridge 100 has been installed in the holder 1000. The control circuitry of the ink-jet printer 10 will thereby be able to read out information data from the memory, as well as to write data. As depicted in FIG. 5A, the container-side electrodes 151 are arranged in a staggered two-row pattern.

The ink feed part 110 is situated at the center part in the lengthwise direction (Z axis direction) of the front wall surface F1, and at the center part of the latitudinal direction (X axis direction) of the front wall surface F1. The positioning hole 120 and the flat positioning part 130 are situated towards the top wall surface F3 side (Z axis positive direction side) from the ink feed part 110, and in proximity to the top wall surface F3. The positioning hole 120 and the flat positioning part 130 are situated in proximity to the circuit board 150. This is so that with the ink cartridge 100 installed in the holder 1000, the container-side electrode will be precisely positioned with respect to the holder-side electrode, discussed later. The guide hole 140 is situated towards the bottom wall surface F2 side (Z axis negative direction side) from the ink feed part 110, and in proximity to the bottom wall surface F2.

Figure 6:
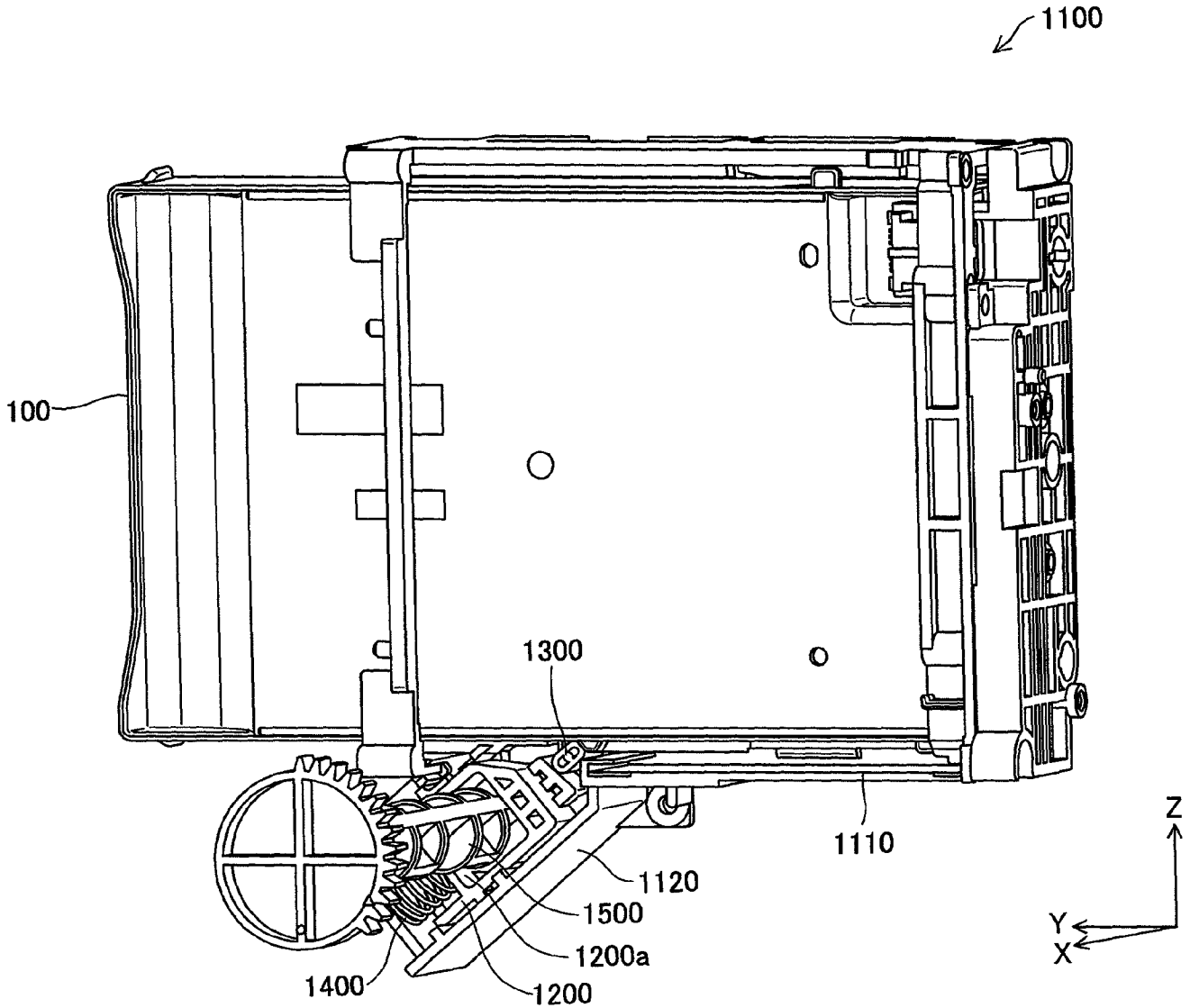
FIG. 6 is a perspective view of the holder body.

FIG. 6 is a perspective view of the holder body 1100. The holder body 1100 has a case part 1110 and a lock housing part 1120. The ink cartridge 100, with its front wall surface F1 facing forward, is inserted into the case part 1110 with the Y axis negative direction as the insertion direction. A hook member 1300 is fastened to the case part 1110. The lock housing part 1120 houses a reciprocating member 1200 and a coil spring 1400. In the reciprocating member 1200 there is formed a through-hole 1200*a* that passes through it in the X axis direction; and the lock shaft 1500 is passed through this through-hole 1200*a*.

Figure 7:
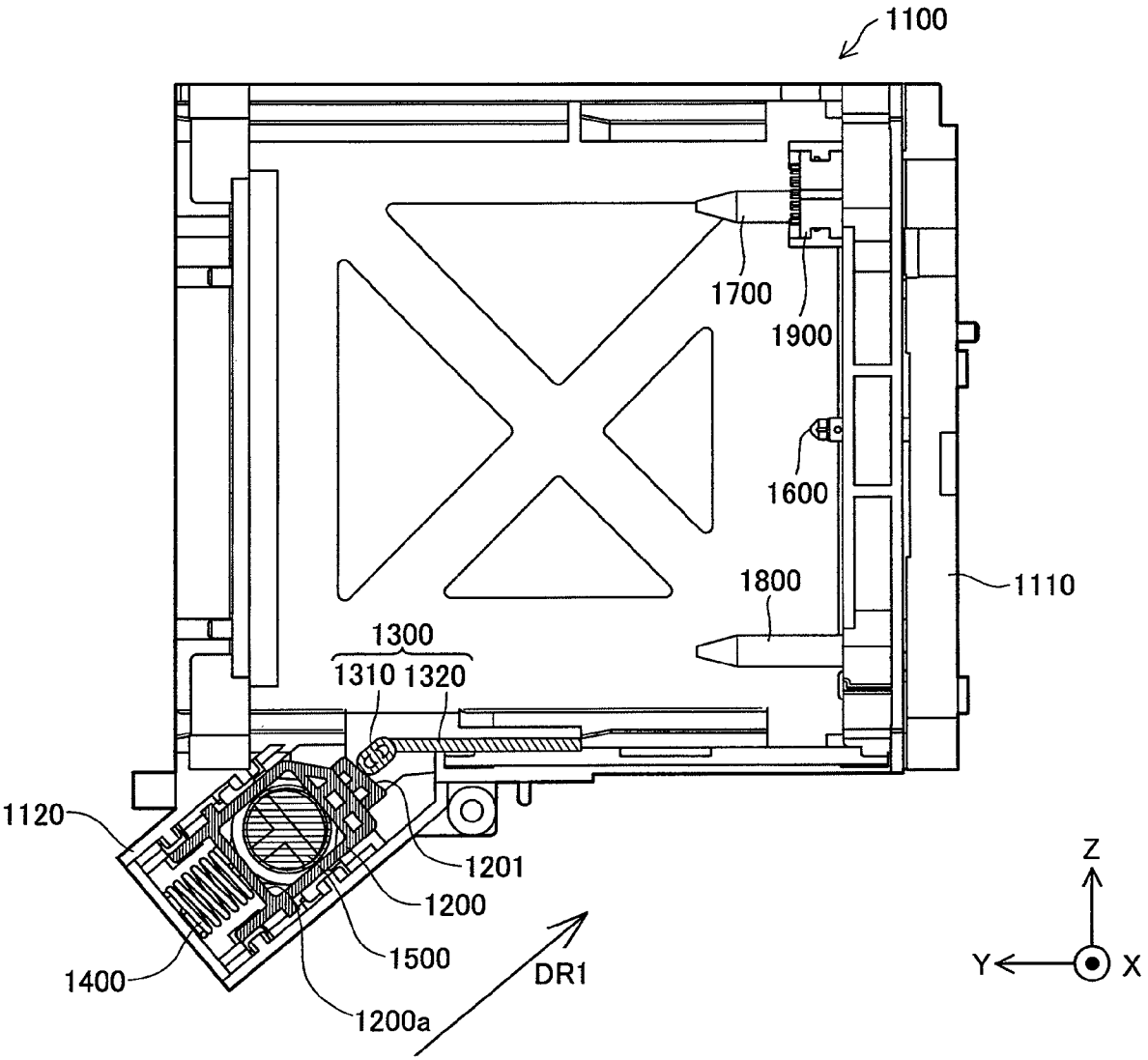
FIG. 7 depicts the holder body viewed from the X axis positive direction side.

FIG. 7 depicts the holder body 1100 viewed from the X axis positive direction side. From the wall of the Y axis negative direction side of the case body 1110 there respectively project an ink intake needle 1600, a positioning pin 1700, a guide pin 1800, and holder-side electrode 1900.

Figure 8:
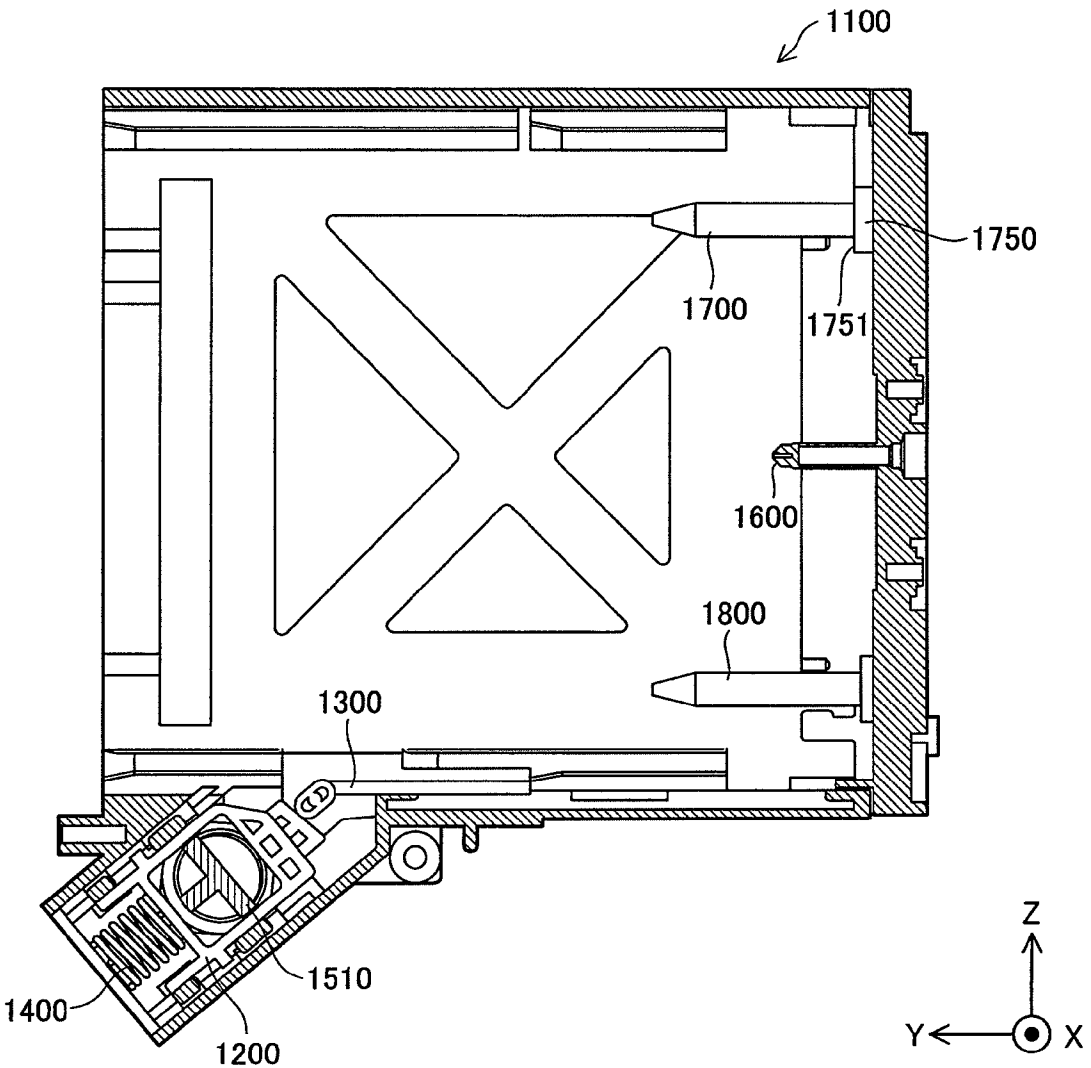
FIG. 8 is a sectional view of the holder body taken in a plane that passes through the center of the X-Z cross section of the ink intake needle and that lies parallel to the Y-Z plane.

FIG. 8 is a sectional view of the holder body 1100 taken in a plane that passes through the center of the X-Z cross section of the ink intake needle 1600 and that lies parallel to the Y-Z plane. A stage member 1750 is provided to the basal section of the positioning pin 1700. The surface of the stage member 1750 lying towards the Y direction defines a device-side flat part 1751. With the ink cartridge 100 installed in the case part 1110, the positioning pin 1700 inserts into the positioning hole 120. With the ink cartridge 100 installed in the case part 1110, this device-side flat part 1751 abuts the flat positioning part 130. With the ink cartridge 100 installed in the case part 1110, the ink intake needle 1600 inserts into the ink feed port of the ink feed part 110. Also, with the ink cartridge 100 installed in the case part 1110, the guide pin 1800 inserts into the guide hole 140.

In FIG. 7, the hook member 1300, the reciprocating member 1200, and the lock shaft 1500 are indicated by hatching. The hook member 1300 is furnished with an abutting member 1310 and a support member 1320. The abutting member 1310 is integrally formed on the support member 1320 at the end of thereof lying towards the positive direction in the Y axis. The end of the support member 1320 lying towards the negative direction in the Y axis is fastened to the case part 1110. The hook member 1300 is made of a resin such as plastic; the abutting member 1310 is capable of oscillating motion in the vertical direction (Z axis direction), centered on the fastened part of the support member 1320 and the case part 1110. The reciprocating member 1200 is housed within the lock housing part 1120 so as to enable reciprocating movement along a prescribed biasing direction DR1. The face of the reciprocating member 1200 lying towards the biasing direction DR1 defines a hook-abutting face 1201 adapted to be positioned abutting the abutting member 1310. The coil spring 1400 urges the reciprocating member 1200 in the biasing direction DR1.

In FIG. 8, the member 1500 of the lock shaft 1500 indicated by hatching is a stopper member. When the lock shaft 1500 rotates about a rotation axis parallel to the X axis, the stopper member 1510 will rotate as well, in tandem with the lock shaft 1500. With the lock shaft 1500 in a first rotation position, the stopper member 1510 will be prevented from moving in the opposite direction from the biasing direction DR1; whereas with the lock shaft 1500 in a second rotation position, the stopper member 1510 will be allowed to move in the opposite direction from the biasing direction DR1. FIG. 8 depicts the lock shaft 1500 in the second rotation position.

Figure 9:
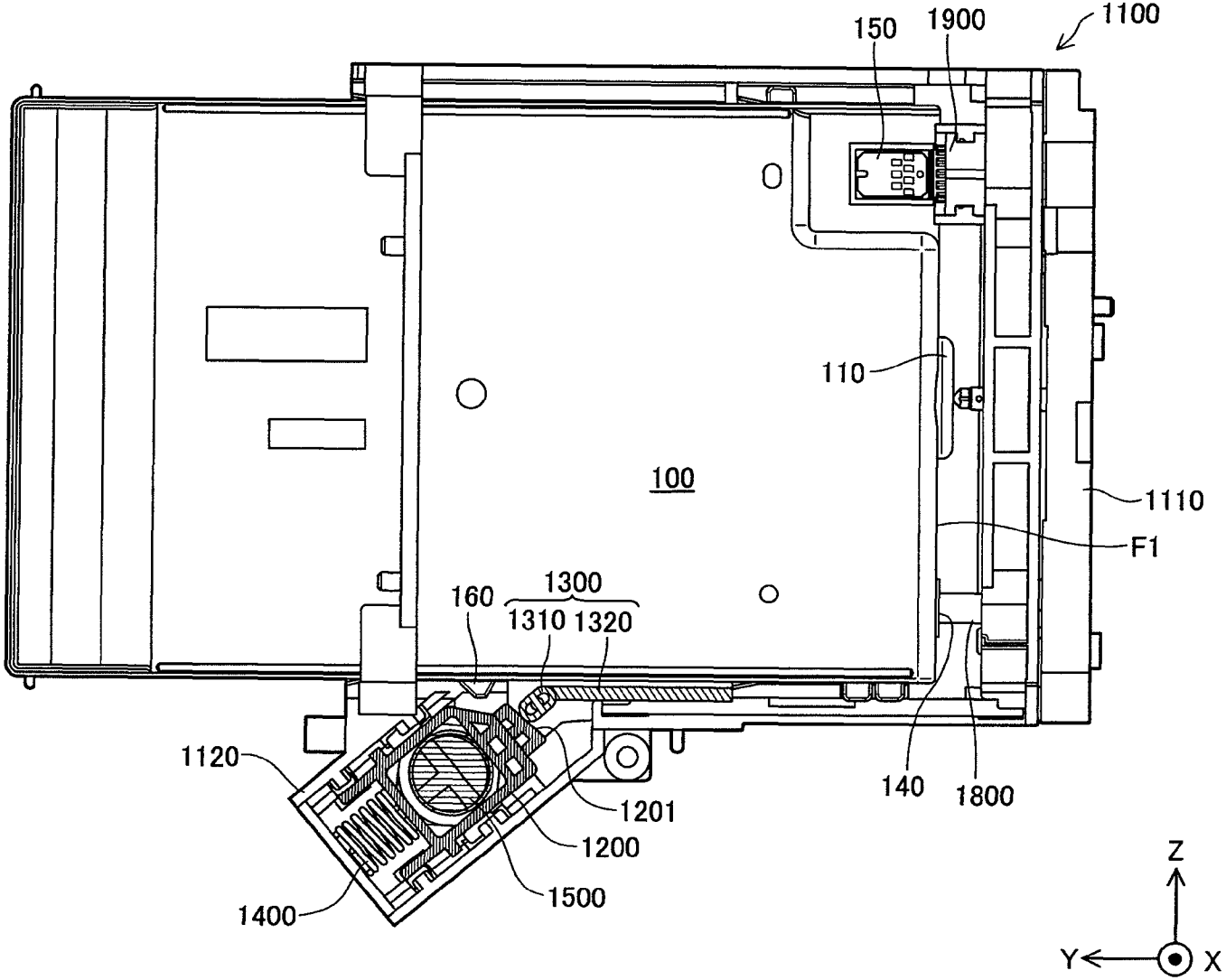
FIG. 9 is a first diagram depicting the ink cartridge as it is being inserted into the holder body.

FIG. 9 is a first diagram depicting the ink cartridge 100 as it is being inserted into the holder body 1100. When the ink cartridge 100, with its front wall surface F1 facing forward, is inserted in the insertion direction, the guide hole 140 will engage with the tip of the guide pin 1800 and guide it in the insertion direction. Similarly, the positioning hole 120 will engage with the tip of the positioning pin 1700. The circuit board 150 will come in proximity with the holder-side electrode 1900.

Figure 10:
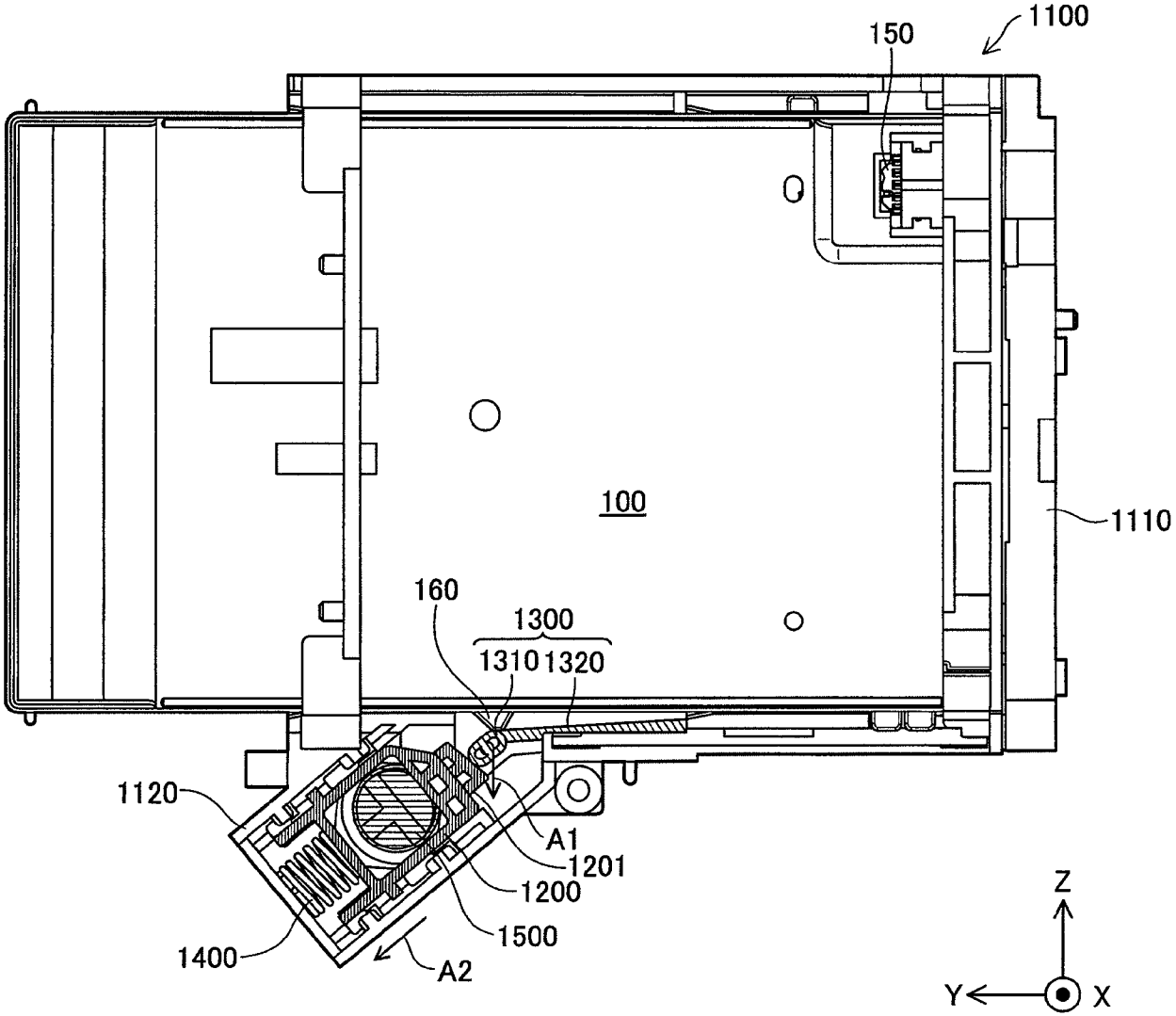
FIG. 10 is a second diagram depicting the ink cartridge as it is being inserted into the holder body.

FIG. 10 is a second diagram depicting the ink cartridge 100 as it is being inserted into the holder body 1100. As the ink cartridge 100 is inserted further in the insertion direction, the ink supply port of the ink feed part 110 will engage with the ink intake needle 1600. The third face 164 of the bias-force receiving part 160 disposed on the bottom wall surface F2 of the ink cartridge 100 will then come into abutment with the hook member 1300 and push down the abutting member 1310 in the downward direction (FIG. 10: arrow A1). The abutting member 1310 thusly pushed down will in turn push down the hook-abutting face 1201 of the reciprocating member 1200, whereupon the reciprocating member 1200 will move in the opposite direction from the biasing direction DR1 (FIG. 10: arrow A2) in the lock housing part 1120. In association with movement of the reciprocating member 1200, the coil spring 1400 will constrict in the same direction.

Figure 11:
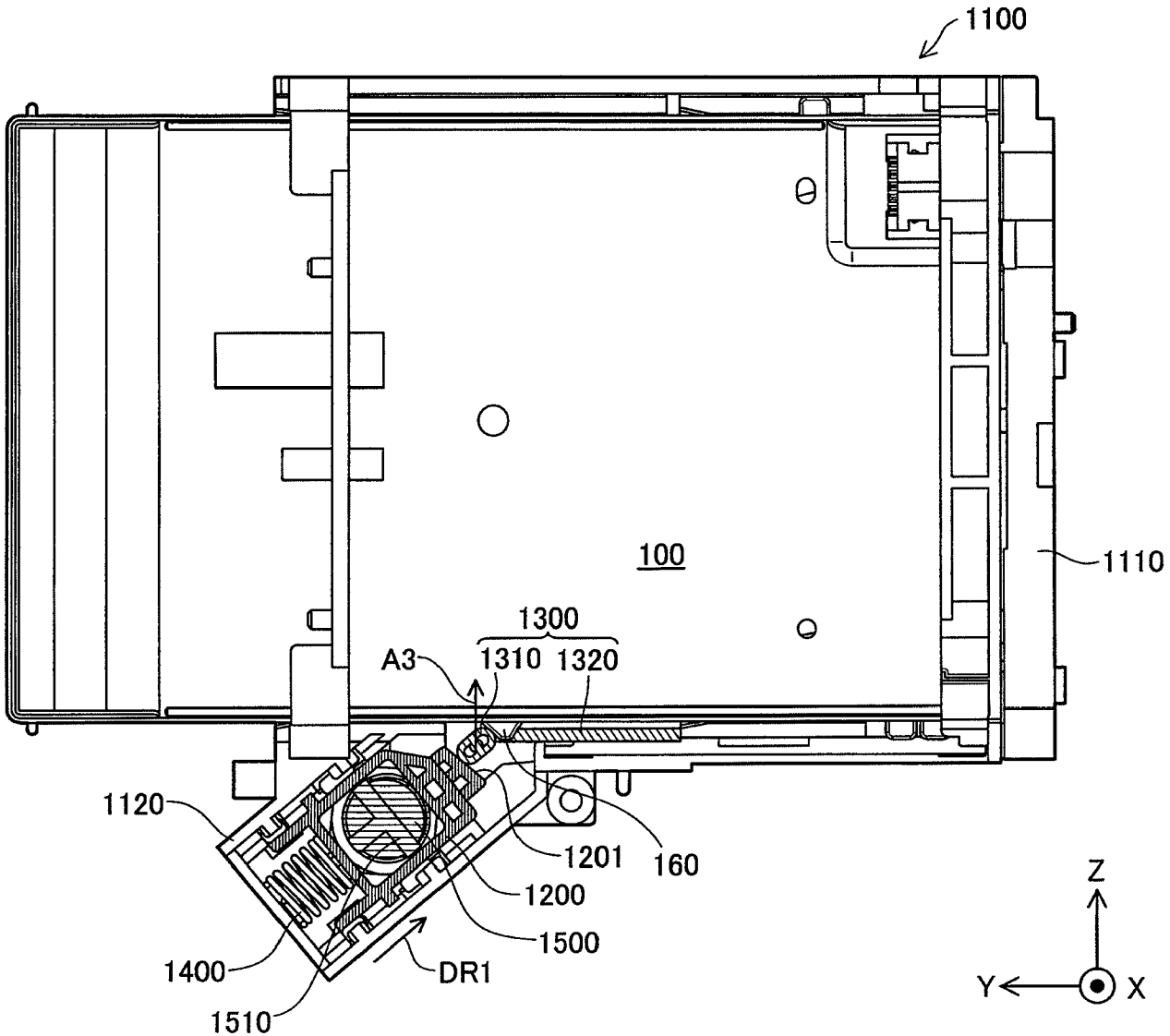
FIG. 11 is a first diagram depicting the ink cartridge installed in the holder body.

FIG. 11 is a first diagram depicting the ink cartridge 100 installed in the holder body 1100. As the ink cartridge 100 is inserted further in the insertion direction, the ink intake needle 1600 will insert all the way into the ink supply port of the ink feed part 110. The positioning pin 1700 will insert all the way into the positioning hole 120, and the device-side flat part 1751 situated at the base of the positioning pin 1700 will come into abutment with the flat positioning part 130 situated at the aperture of the positioning hole 120. The container-side electrode 151 of the circuit board 150 will be secured at locations contacting the corresponding holder-side electrode 1900.

With the ink cartridge 100 completely installed in the holder body 1100 in the condition depicted in FIG. 11, the abutting member 1310, which in the condition depicted in FIG. 10 had been pushed down, will now be pushed back in the upward direction (FIG. 11: arrow A3) and come into abutment against the urged face 162 of the bias-force receiving part 160. The abutting member 1310, at the location of abutment thereof against the urged face 162, will receive biasing force directed in the biasing direction DR1 from the hook-abutting face 1201 of the reciprocating member 1200. This biasing force directed in the biasing direction DR1 will act on the urged face 162 of the ink cartridge 100 via the abutting member 1310.

Figure 12:
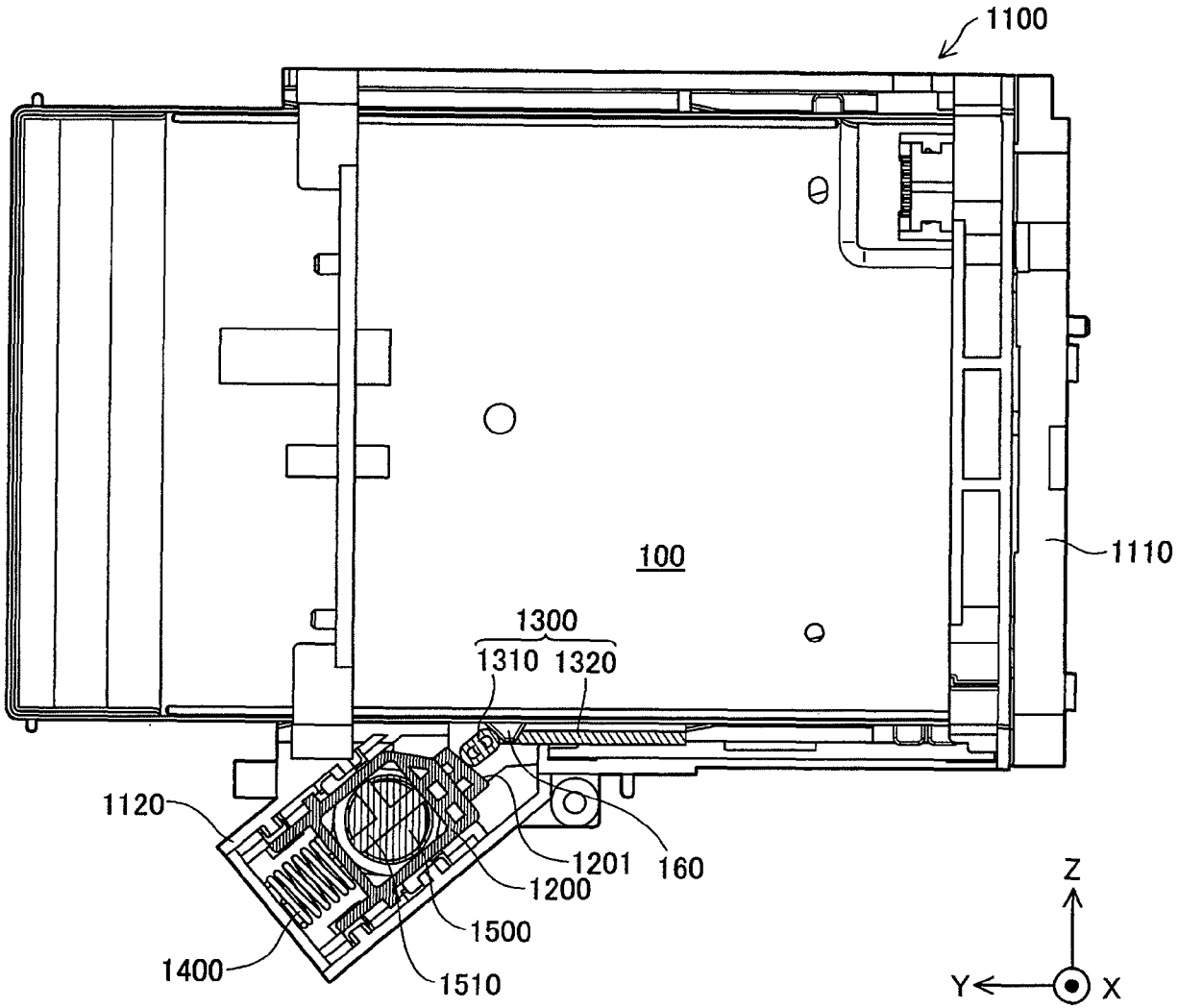
FIG. 12 is a second diagram depicting the ink cartridge installed in the holder body.

FIG. 12 is a second diagram depicting the ink cartridge 100 installed in the holder body 1100. In the condition depicted in FIG. 11, the rotation position of the lock shaft 1500 is the release position, allowing the reciprocating member 1200 to move in the opposite direction from the biasing direction DR1. In the condition depicted in FIG. 12 on the other hand, the rotation position of the lock shaft 1500 is the locking position, preventing the reciprocating member 1200 from moving in the opposite direction from the biasing direction DR1. That is, when the rotation position of the lock shaft is the locking position, the stopper member 1510 abuts the inside wall on the biasing direction DR1 side of the through-hole 1200*a* of the reciprocating member 1200.

Figure 13:
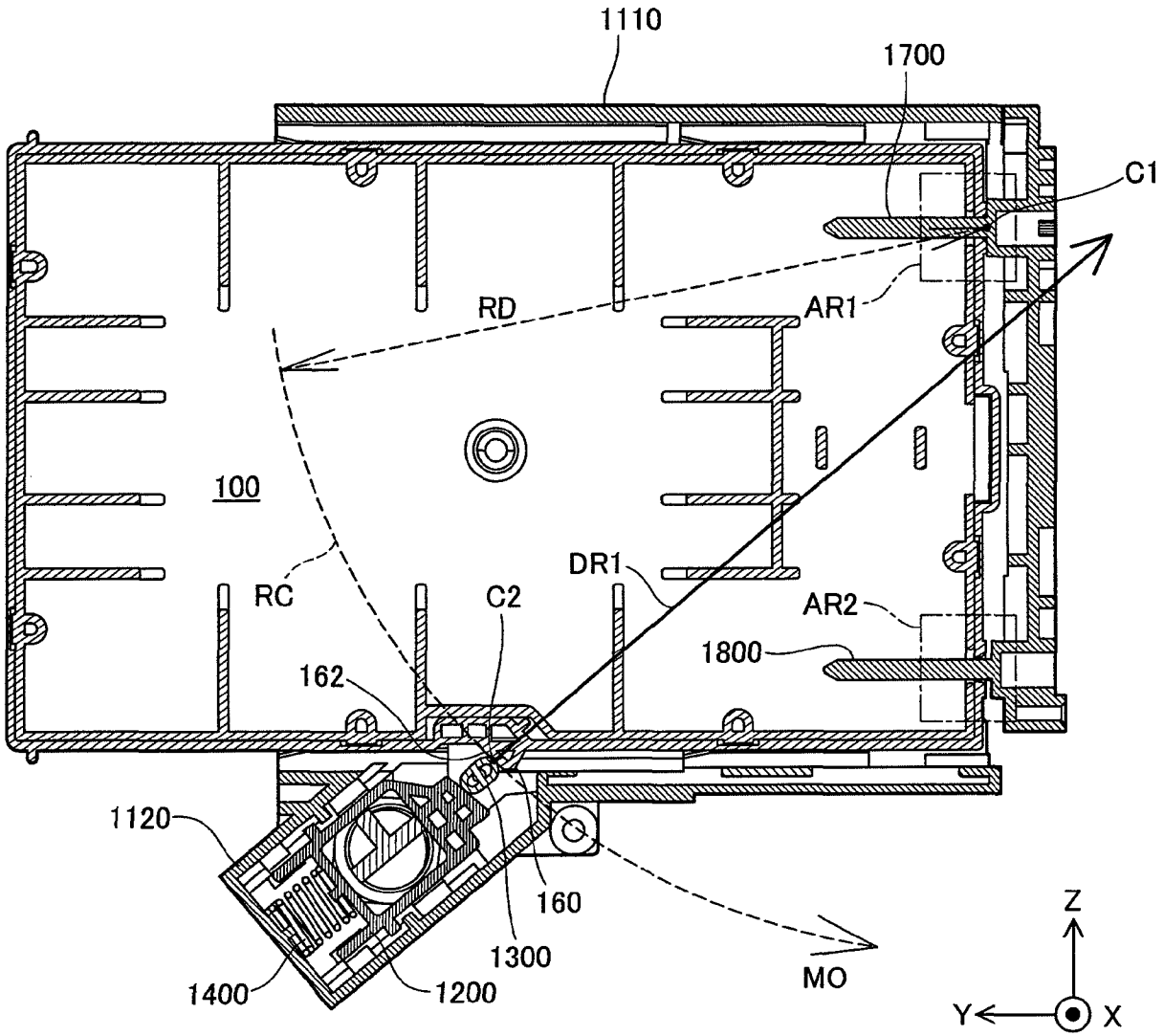
FIG. 13 is a sectional view of the holder body and the ink cartridge installed therein, taken in a plane that passes through the center of the Z-X cross section of the positioning pin 1700 and that lies parallel to the Z-Y plane.

FIG. 13 is a sectional view of the holder body 1100 and the ink cartridge 110 installed therein, taken in a plane that passes through the center of the Z-X cross section of the positioning pin 1700 and that lies parallel to the Z-Y plane. In FIG. 13, point C1 indicates the positioning point of positioning by the container-side positioning part, i.e. the positioning hole 120 and the flat positioning part 130, and by the device-side positioning part, i.e. the positioning pin 1700 and the device-side flat part 1751.

Figure 14A:
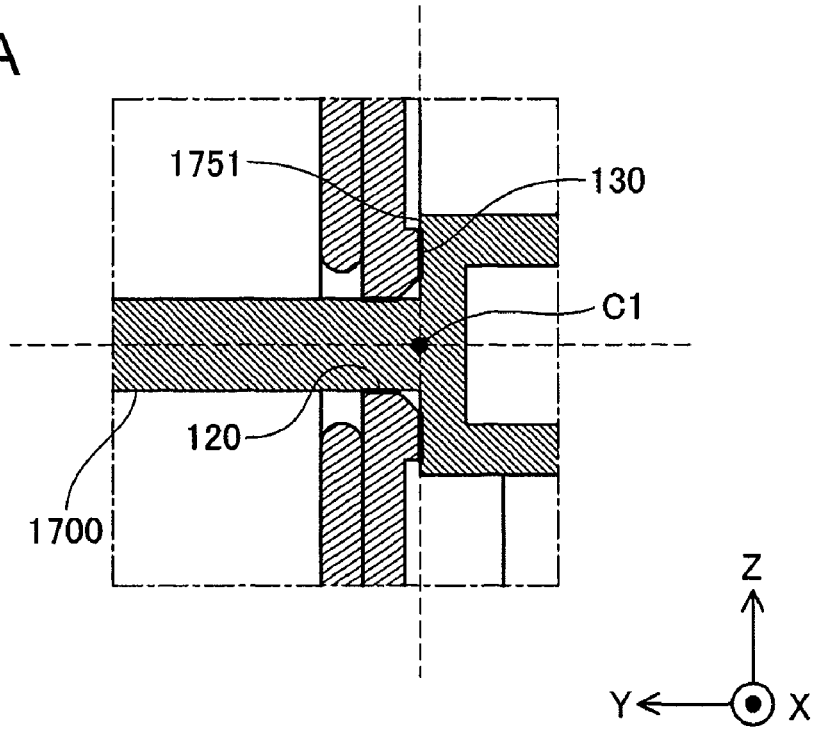
FIGS. 14A-B are enlarged views of a first area AR1 and a second area AR2 in FIG. 13.
Figure 14B:
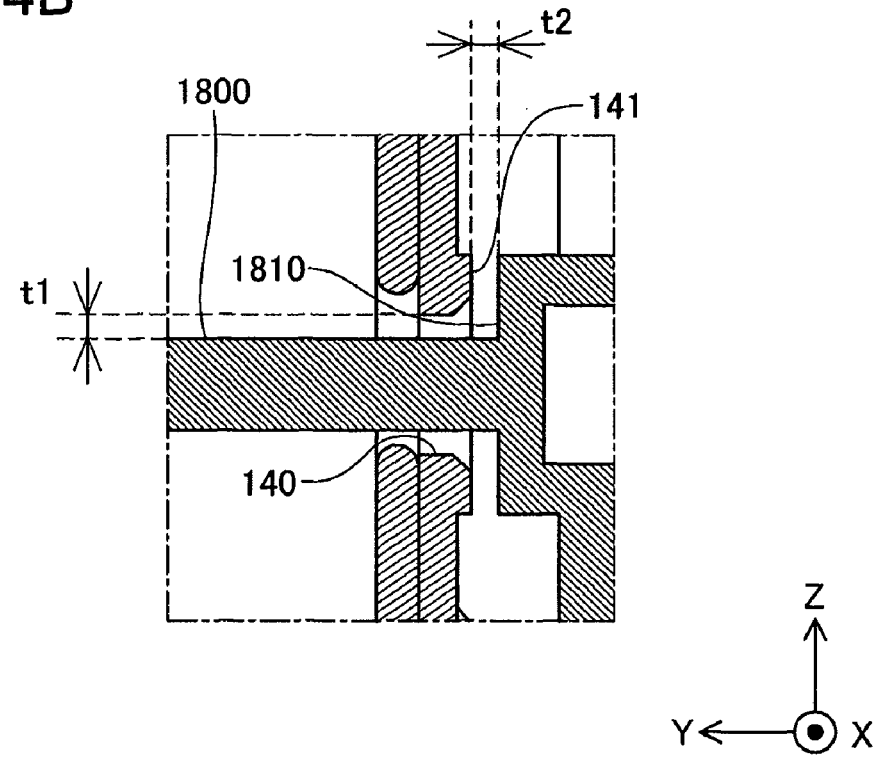

FIGS. 14A-B are enlarged views of a first area AR1 and a second area AR2 in FIG. 13. When the ink cartridge 100 has been correctly installed in the holder body 1100, the inside face of the positioning hole 120 of the ink cartridge 100 and the outside face of the positioning pin 1700 will be in abutment. Through this abutment, the ink cartridge 100 will be positioned in the X axis direction and the Z axis direction with respect to the holder body 1100 will be determined. Also, when the ink cartridge 100 has been correctly installed in the holder body 1100, the flat positioning part 130 of the ink cartridge 100 and the device-side flat part 1751 will be in abutment. Through this abutment, the ink cartridge 100 will be positioned in the Y axis direction with respect to the holder body 1100. As will be appreciated from the above discussion, the intersection point C1 of plane that includes the flat positioning part 130 with the center axis of the positioning hole 120 is the positioning location. The positioning point C1 is located in proximity to the location for electrical connection of the container-side electrode 151 of the circuit board 150 with the holder-side electrode 1900. This is so as to ensure precise contact between the container-side electrode 151 and the holder-side electrode 1900. That is, by establishing the positioning point C1 close by, the location of the container-side electrode 151 with respect to the holder-side electrode 1900 will be secured when the ink cartridge 100 has been installed in the holder body 1100.

A gap t1 is provided between the outside face of the guide pin 1800 and the inside face of the guide hole 140. A gap t2 is provided between a flat face 1810 situated at the base of the guide pin 1800, and a flat face 141 situated at the aperture of the guide hole 140. Consequently, the guide pin 1800 and the guide hole 140 do not perform a positioning function.

The description now continues, referring back to FIG. 13. In FIG. 13, an arc RC centered on the positioning point C1 and having radius RD is shown by a broken line. The arc RC passes through the contact point C2 of the hook member 1300 and the urged face 162. The urged face 162 lies parallel to the circumferential direction of the arc RC at the contact point C2. That is, the urged face 162 lies along the arc RC that is centered on the positioning point C1 and that passes through the contact point C2.

As depicted in FIG. 13, a line extending in the biasing direction DR1 from the contact point C2 will pass to the lower side (the Z axis minus direction side) of the positioning point C1 and of the container-side electrode 151 that have been fastened at the positioning point C1.

When the ink cartridge 100 has been installed in the holder body 1100, the ink-jet printer 10 will be supplied with ink from the ink cartridge via the ink intake needle 1600 so that printing can be carried out using the supplied ink.

According to the embodiment described above, with the ink cartridge 100 installed in the holder 1000, the urged face 162 of the ink cartridge 100 will be urged in the biasing direction DR1. As noted, the extended line extending in the biasing direction DR1 from the contact point C1 of the urged face 162 passes to the lower side (the Z axis minus direction side) of the positioning point C1 and of the container-side electrode 151 that have been fastened at the positioning point C1. As a result, rotational moment MO in the direction shown by the arrow MO in FIG. 13 and centered about the positioning point C1 and the container-side electrode 151 that have been fastened at the positioning point C1 will be applied. As will be appreciated from FIG. 13, this rotational moment coincides with the direction pushing the ink feed part 110 of the ink cartridge 100 onto the ink intake needle 1600. As a result, the ink cartridge 100 can be prevented from becoming dislodged from the holder 1000.

Additionally, the urged face 162 lies along the arc RC that is centered on the positioning point C1 and that passes through the contact point C2. Thus, the urged face 162 can be held in abutment against the abutting member 1310, even if the ink cartridge 100 should move about the positioning point C1 to some extent. As a result, the ink cartridge 100 can be prevented from becoming dislodged from the holder 1000.

Furthermore, by extending the urged face 162 of the ink cartridge out as far as the recessed portion base face F8 of the receptacle body 101, sufficient length of the urged face 162 in the circumferential direction of the arc RC is assured. As a result, the urged face 162 can be held in abutment against the abutting member 1310, even if the ink cartridge 100 should move about the positioning point C1 to some extent. As a result, the ink cartridge 100 can be prevented from becoming dislodged from the holder 1000.

Additionally, the bias-force receiving part 160 is disposed on the bottom wall surface F2 of the ink cartridge 100. Thus, in the holder 1000, the bias force part, namely the lock housing part 1120, the reciprocating member 1200, the hook member 1300, the lock shaft 1500 etc., can be disposed to the lower side of the holder 1000. As a result, large size of the holder 1000 at its upper side can be avoided. In the present embodiment, as the printing system composed of the ink-jet printer 10 and the ink cartridges 100 is of hydraulic head feed design in which ink is supplied by gravity, the installation height of the ink cartridges 100 will be determined by a certain required minimum hydraulic head location with respect to the print head location, and thus the holder 1000 will have to be positioned at a certain height in the ink-jet printer 10. If the holder 1000 were larger at its upper side due to the bias force part being disposed there, this would pose a risk of a bulkier ink-jet printer 10 overall.

Further, in the bias force part, because a coil spring 140 is employed as the biasing member for biasing the reciprocating member 1200, costs will be lower as compared with where a plate spring is used. Also, the holder 1000 is designed so that the large ink cartridge 100*b* is installed in the leftmost holder body 1100, and each ink cartridge 100 has a back wall surface F5 with grip-like contours for gripping from the right side. As a result, good grippability can be assured for all of the ink cartridges 100 installed in the holder 1000. Moreover, because the holder 1000 is composed of connected identical holder bodies 1100 in a number equal to the number of colors used by the printer 10, the number of different part types can be reduced. Additionally, switching between a state in which detachment of an ink cartridge 100 is allowed and a state in which detachment of an ink cartridge 100 is prevented can be accomplished through the simple arrangement of rotating the lock shaft 1500.

B. Variations

Variation 1:

While in the preceding embodiment, positioning was accomplished by providing a positioning hole on the ink cartridge 100 side and a positioning pin on the holder 1000 side, this arrangement is not limiting, and other positioning structures would be possible instead. For example, the positioning hole could be provided on the holder side, and the positioning pin provided on the ink cartridge side. A positioning structure that combines a groove part and a rib part that mates with the slot could be employed as well.

Variation 2:

In the preceding embodiment, the ink supply port is provided on the ink cartridge 100 side and the ink supply needle is provided on the holder 1000 side, but this arrangement is not limiting, and other ink supply structures would be possible instead. For example, the ink supply port could be provided on the holder side and the ink supply needle provided on the ink cartridge side.

Variation 3:

In the preceding embodiment, each single ink tank constitutes a single ink cartridge 100; however, several ink tanks could constitute a single ink cartridge 100.

Variation 4:

While the preceding embodiment described a printer and an ink cartridge for use in an ink-jet system, it would be possible instead to employ a liquid jetting apparatus that jets or ejects some other liquid besides ink, and a liquid container for containing the liquid. Herein, the term liquid is used to include liquid forms such as particles of a functional material dispersed in a medium, or fluid forms such as gel forms. Examples of liquid jetting apparatus would include liquid jetting apparatus adapted to jet liquids that contain materials such as electrode materials or coloring matter in dispersed or dissolved form, and employed in manufacturing liquid crystal displays, EL (electroluminescence) displays, plane emission displays, or color filters; liquid jetting apparatus adapted to jet liquids that contain bioorganic substances used in biochip manufacture; or liquid jetting apparatus adapted to jet liquids as specimens for use as precision pipettes. Additional examples are liquid jetting apparatus for pinpoint jetting of lubricants onto precision instruments such as clocks or cameras; liquid jetting apparatus adapted to jet an ultraviolet-curing resin or other transparent resin solution onto a substrate for the purpose of forming a micro semi-spherical lens (optical lens) for use in optical communication elements etc.; or liquid jetting apparatus adapted to jet an acid or alkali etchant solution for etching circuit boards etc. The present invention is adaptable to liquid relaying devices for any of the above classes of jetting devices and liquids.

While the liquid container pertaining to the invention have been shown and described on the basis of the embodiment and variation, the embodiments of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A liquid container, installable in a holder of a liquid jetting apparatus having a holder-side electrode that electrically connects with the liquid container; a liquid feed needle that receives liquid from the liquid container; and a bias force part provided on a lower position than a position of the liquid feed needle and adapted to exert a bias force on the liquid container, when the liquid container is installed in the holder, the liquid container including:

a front wall having a liquid feed port arranged to receive the liquid feed needle when the liquid container is installed in the holder, the front wall being parallel to an X-direction and a Z-direction and orthogonal to a Y direction, the X, Z and Y-directions being orthogonal to each other;

a container-side electrode arranged to electrically connect with the holder-side electrode when the liquid container is installed in the holder;

a first side wall orthogonal to the front wall and parallel to the X and Y-directions;

a second side wall orthogonal to the front wall, parallel to the X and Y-directions, and opposite to the first side wall; and a bias-force receiving part provided on the first side wall and not provided on the second side wall, the bias-force receiving part is arranged to receive the bias force applied from the bias force part of the holder when the liquid container is installed in the holder, in a biasing direction such that an extended line of the biasing direction from the bias-force receiving part to the front wall passes between the container-side electrode and the side wall, when viewed in the X-direction.

2. The liquid container in accordance with claim 1, further including a positioning hole provided in the front wall adapted to receive a positioning pin provided in the holder to position the container-side electrode to the holder-side electrode at a positioning point, when the liquid container is installed in the holder, wherein the bias-force receiving part is arranged to receive the bias force in the biasing direction such that the extended line passes between the positioning point and the side wall, when viewed in the X-direction.

3. The liquid container in accordance with claim 2, wherein, the bias-force receiving part includes an abutting face adapted to abut a hook included in the bias force part of the holder, and the abutting face lies on a circular arc that is centered on the positioning point, when viewed in the X-direction.

4. The liquid container in accordance with claim 3, further comprising a recessed part provided in the side wall and having a recessed face, wherein the abutting face is projected from the recessed face.

5. The liquid container in accordance with claim 2, further comprising a flat part disposed on and projected from the front wall at a rim of the positioning hole, the flat part adapted to abut a part of a stage member provided to the basal section of the positioning pin of the holder, when the liquid container is installed in the holder.

6. A holder, adapted to receive a liquid container) having a front wall including a liquid feed port provided at a center part of the front wall, the front wall being parallel to an X-direction and a Z-direction, and orthogonal to a Y direction, the X, Z and Y-directions being orthogonal to each other; a first side wall orthogonal to the front wall and parallel to the X and Y-directions; a second side wall orthogonal to the front wall and opposite to the first side wall; a positioning hole provided in the front wall at a position between the second side wall and the liquid feed port; and a bias-force receiving part provided on the first side wall and not provided on the second side wall, the holder comprising:

a liquid intake needle arranged to connect to the liquid feed port when the liquid container is installed;

a positioning pin adapted to be inserted in the positioning hole when the liquid container is installed; and a bias force part arranged to exert a bias force on the bias-force receiving part provided on the first side wall and not provided on the second side wall of the liquid container when the liquid container is installed, the bias force is exerted by the bias force part in a biasing direction such that an extended line of the biasing direction from the bias-force receiving part to the front wall of the liquid container passes between the positioning hole and the first side wall of the liquid container, when viewed in the X-direction.

7. The holder in accordance with claim 6, wherein the bias force part is provided at a lower position than a position of the liquid intake needle.

8. The holder in accordance with claim 6, wherein the bias force part includes:

a hook swingable in a vertical direction and having a first abutting part adapted to abut the bias-force receiving part when the liquid container is installed, a reciprocating member reciprocatable in the biasing direction and having a second abutting part adapted to abut the hook, and a resilient member arranged to bias the reciprocating member in the biasing direction.

9. The holder in accordance with claim 8, wherein the resilient member includes a coil spring.

10. The holder in accordance with claim 8, wherein the reciprocating member includes a through-hole passing through in a direction substantially orthogonal to the biasing direction, the bias force part further includes a shaft adapted to rotatably fit the through-hole and rotate between a first rotational position and a second rotational position, the shaft includes a stopper adapted to rotate with the shaft, the stopper prevents the reciprocating member from moving when the shaft being in the first rotational position.

11. The holder in accordance with claim 10, wherein the holder is arranged to receive a plurality of liquid containers, the hook, the reciprocating member, and the resilient member of bias force part are provided individually for each of the plurality of liquid containers, and the shaft is provided mutually to fit each of the through-holes of the plurality of the reciprocating members.

12. The holder in accordance with claim 6, further comprising a holder-side electrode arranged to contact a container-side electrode of the liquid container arranged on a face lying along an insertion direction parallel to the Y-direction, when the liquid container is installed, the holder-side electrode is provided proximity to the positioning pin.

13. The holder in accordance with claim 6, further comprising a stage member provided to the basal section of the positioning pin adapted to abut a flat part provided on and projected from the front wall at a rim of the positioning hole of the liquid container, when the liquid container is installed.

14. A liquid jetting apparatus having the holder in accordance with claim 6, and adapted to jet a liquid supplied from the liquid container.

15. A liquid jetting system comprising the liquid container in accordance with claim 1.

16. A liquid jetting system comprising the holder in accordance with claim 6.

* * * * *